US010107155B2

(12) United States Patent
Lee et al.

(10) Patent No.: US 10,107,155 B2
(45) Date of Patent: Oct. 23, 2018

(54) VALVE TIMING CONTROL APPARATUS OF INTERNAL COMBUSTION ENGINE

(71) Applicants: Hyundai Motor Company, Seoul (KR); Hitachi Automotive Systems, Ltd., Hitachinaka-shi (JP)

(72) Inventors: Hong Wook Lee, Seongnam-si (KR); Bonghoon Han, Seoul (KR); Jaechun Kim, Hwaseong-si (KR); Hyung Ick Kim, Seoul (KR); Yoshihiko Yamada, Atsugi (JP); Manabu Katayama, Atsugi (JP); Seiji Tsuruta, Atsugi (JP)

(73) Assignees: Hyundai Motor Company, Seoul (KR); Hitachi Automotive Systems, Ltd., Ibaraki (JP)

( * ) Notice: Subject to any disclaimer, the term of this patent is extended or adjusted under 35 U.S.C. 154(b) by 155 days.

(21) Appl. No.: 15/358,071

(22) Filed: Nov. 21, 2016

(65) Prior Publication Data

US 2017/0167317 A1 Jun. 15, 2017

(30) Foreign Application Priority Data

Dec. 9, 2015 (KR) ..... 10-2015-0175301

(51) Int. Cl.
*F01L 13/06* (2006.01)
*F01L 9/04* (2006.01)
(Continued)

(52) U.S. Cl.
CPC ..... *F01L 9/04* (2013.01); *F01L 1/047* (2013.01); *F01L 1/10* (2013.01); *F01L 1/348* (2013.01);
(Continued)

(58) Field of Classification Search
CPC ..... F01L 2001/0476; F01L 1/344; F01L 1/46; F01L 13/06; F01L 2013/103; F01L 2820/032
(Continued)

(56) References Cited

U.S. PATENT DOCUMENTS

2009/0199797 A1* 8/2009 Schafer ..... F01L 1/34 123/90.17
2011/0253085 A1 10/2011 Kokubo et al.
(Continued)

FOREIGN PATENT DOCUMENTS

JP 10-141025 A 5/1998
JP 2002-61727 A 2/2002
(Continued)

OTHER PUBLICATIONS

European Search Report, dated May 3, 2017, in European Patent Application No. 16198835.7.

*Primary Examiner* — Jorge Leon, Jr.
(74) *Attorney, Agent, or Firm* — Morgan, Lewis & Bockius LLP

(57) ABSTRACT

A valve timing control apparatus of an internal combustion engine may include a driving rotational body to which torque is transmitted from a crankshaft, a driven rotational body fixed to a camshaft to which torque is transmitted from the driving rotational body, an electric motor disposed between the driving rotational body and the driven rotational body and relatively rotating the driving rotational body and the driven rotational body when electric power is applied thereto, and a deceleration mechanism that decelerates a rotational speed of the electric motor and transmits the decelerated rotational speed to the driven rotational body.

8 Claims, 8 Drawing Sheets

(51) Int. Cl.

| | |
|---|---|
| ***F01L 1/047*** | (2006.01) |
| ***F01L 1/348*** | (2006.01) |
| ***F01L 1/10*** | (2006.01) |
| *F01L 1/46* | (2006.01) |
| *F01L 13/00* | (2006.01) |
| *F01L 1/344* | (2006.01) |

(52) U.S. Cl.
CPC ..... *F01L 1/344* (2013.01); *F01L 1/46* (2013.01); *F01L 13/06* (2013.01); *F01L 2001/0476* (2013.01); *F01L 2013/103* (2013.01); *F01L 2820/032* (2013.01)

(58) Field of Classification Search
USPC ..... 123/90.11, 90.17
See application file for complete search history.

(56) References Cited

U.S. PATENT DOCUMENTS

| | | | | |
|---|---|---|---|---|
| 2014/0076253 | A1* | 3/2014 | Kokubo ..... | F01L 1/344<br>123/90.17 |
| 2015/0211392 | A1* | 7/2015 | Otsubo ..... | F01L 1/352<br>475/162 |

FOREIGN PATENT DOCUMENTS

| | | | |
|---|---|---|---|
| JP | 2005-264898 | A | 9/2005 |
| JP | 2008-38886 | A | 2/2008 |
| JP | 2010-48233 | A | 3/2010 |
| JP | 2010-159738 | A | 7/2010 |
| JP | 2011-231700 | A | 11/2011 |
| JP | 2012-189050 | A | 10/2012 |

* cited by examiner

VALVE TIMING CONTROL APPARATUS OF INTERNAL COMBUSTION ENGINE

CROSS-REFERENCE TO RELATED APPLICATION

The present application claims priority to Korean Patent Application No. 10-2015-0175301, filed Dec. 9, 2015, the entire contents of which is incorporated herein for all purposes by this reference.

BACKGROUND OF THE INVENTION

Field of the Invention

The present invention relates to a valve timing control apparatus of an internal combustion engine for controlling closing/opening timing of an intake valve and an exhaust valve.

Description of Related Art

In the related art, a valve timing control apparatus which may change and control a relative rotation phase of a camshaft with respect to a sprocket to which torque is transmitted in a crankshaft by using torque of an electrical motor, is disclosed.

The valve timing control apparatus includes the electrical motor, a motor housing of which is synchronized with the crankshaft and rotated, and a deceleration mechanism that decelerates a rotational speed of the electrical motor to transmit it to the camshaft.

The deceleration mechanism includes an eccentric shaft to which torque transmitted from a motor shaft, a ring shape member that is integrated with the sprocket and includes inner teeth of a waveform shape provided on an inner circumferential surface thereof, a plurality of rollers that are installed between respective inner teeth of the ring shape member and an outer wheel of a ball bearing, and a cage that is installed at the camshaft to form gaps between respective rollers and to allow all of the rollers to move in a radial direction.

A plurality of rollers with different outer diameters are previously prepared, and then are selectively assembled according to a gap between an outer circumferential surface of the rollers and an inner surface of the inner teeth thereof to be an optimal gap.

However, in the conventional valve timing control apparatus described above, the rollers having different outer diameters are selectively assembled such that the gap therebetween is adjusted, but since precision of the outer diameters of respective rollers precision is limited, it is difficult to accurately adjust the gap (backlash).

Accordingly, torque variation caused at the camshaft due to a difference of the gap causes relatively strong impact sound between the outer circumferential surface of the respective rollers and the inner surface of the inner teeth, etc., thus quality thereof deteriorates.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a valve timing control apparatus of an internal combustion engine that may effectively reduce and suppress backlash and occurrence of impact sound between an outer circumferential surface of a roller and of an inner surface of inner teeth thereof.

According to various aspects of the present invention, a valve timing control apparatus of an internal combustion engine may include a driving rotational body to which torque is transmitted from a crankshaft, a driven rotational body fixed to a camshaft to which torque is transmitted from the driving rotational body, an electric motor disposed between the driving rotational body and the driven rotational body and relatively rotating the driving rotational body and the driven rotational body when electric power is applied thereto, and a deceleration mechanism that decelerates a rotational speed of the electrical motor and transmit the decelerated rotational speed to the driven rotational body, in which the decelerator may include an eccentric rotational shaft that receives torque of the electrical motor and is eccentric-rotated, a bearing portion disposed at an outer circumference of the eccentric rotational shaft, an inner tooth formation part integrally disposed at at least one of the driving rotational body and the driven rotational body and to which a plurality of inner teeth are provided at an inner circumference of the inner tooth formation part, a plurality of power transmission bodies that are power-transmissibly disposed between an outer circumferential surface of an outer wheel of the bearing portion and the respective inner teeth of the inner tooth formation part, wherein an engaged portion of the inner tooth moves in a circumferential direction by eccentric rotation of the eccentric rotational shaft, and a maintaining member integrally disposed at a remaining one of the driving rotational body and the driven rotational body, separating respective power transmission bodies, and allowing the respective power transmission bodies to move in a radial direction, in which a recess portion may be formed at at least one of the outer circumference of the eccentric rotational shaft and an inner circumference of the bearing portion, and a pressing member that allows the power transmission body to generate power in a tooth bottom surface direction of the inner tooth through the bearing portion may be disposed at the recess portion.

The pressing member may include a leaf spring bent in a circular arc shape.

The recess portion may be formed with a length along a length direction in which opposite end portions of the leaf spring are freely stretchable.

Opposite end portions of a length direction of the pressing member may contact a bottom surface of the recess portion, and a top portion of the circular arc shape may contacts an inner circumferential surface of an inner wheel of the bearing portion.

The opposite end portions of the pressing member may be formed in a curved line shape outward a radial direction, and lower surfaces of the opposite end portions having the curved line shape may contact the bottom surface of the recess portion.

The recess portion may be formed in a flat bottom shape.

The recess portion may be formed in a "D" cut shape on an outer circumferential surface of the eccentric rotational shaft.

The recess portion may be formed with a width ranging from opposite edges of a width direction of the inner wheel of the bearing portion to an inside portion.

The bearing portion may include balls interposed between an inner wheel and an outer wheel of the bearing portion.

The bearing portion may include a needle bearing having a plurality of rollers interposed between an inner wheel and an outer wheel of the bearing portion.

The recess portion may be formed at an inner circumferential surface of an inner wheel of the bearing portion.

The pressing member may be formed of a metal plate material, and include a rectangular plate-shaped main body and a curved line portion in which opposite end portions of a length direction of the rectangular plate-shaped main body are bent to have a curved shape at a radial directional outside.

According to various aspects of the present invention, a valve timing control apparatus of an internal combustion engine may include a driving rotational body to which torque is transmitted from a crankshaft, a driven rotational body fixed to a camshaft to which torque is transmitted from the driving rotational body, an electric motor that is disposed between the driving rotational body and the driven rotational body and relatively rotates the driving rotational body and the driven rotational body when electric power is applied thereto, and a deceleration mechanism decelerating a rotational speed of the electrical motor and transmitting the decelerated rotational speed to the driven rotational body, in which the deceleration mechanism may include an eccentric rotational shaft receiving torque of the electrical motor and eccentrically-rotated, a bearing portion disposed at an outer circumference of the eccentric rotational shaft, an inner tooth formation part integrally disposed at one of the driving rotational body and the driven rotational body and of which a plurality of inner teeth are provided at an inner circumference of the inner tooth formation part, a plurality of power transmission bodies rotatably disposed between an outer circumferential surface of an outer wheel of the bearing portion and respective inner teeth of the inner tooth formation part, in which an engaged portion of the inner tooth may move in a circumferential direction by eccentric rotation of the eccentric rotational shaft, and a maintaining member integrally disposed at a remaining one of the driving rotational body and the driven rotational body, separating respective power transmission bodies, and allowing all the respective power transmission bodies to move in a radial direction, in which a groove portion may be formed at at least one of the outer circumference of the eccentric rotational shaft and an inner circumference of the bearing portion, and a pressing member that presses the power transmission body against a tooth bottom surface direction of the inner tooth through the bearing portion may be disposed at the groove portion.

The groove portion may include a flat plane portion on which an outer circumferential surface of the eccentric rotational shaft is cut along a tangential direction.

According to the valve timing control apparatus of the internal combustion engine of various embodiments of the present invention, it is possible to effectively suppress occurrence of impact sound between a roller and an inner tooth, etc.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIGS. 6A and 6B illustrate a leaf spring according to various embodiments of the present invention, wherein FIG. 6A illustrates a bird's eye view of the leaf spring, and FIG. 6B illustrates a side view thereof.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
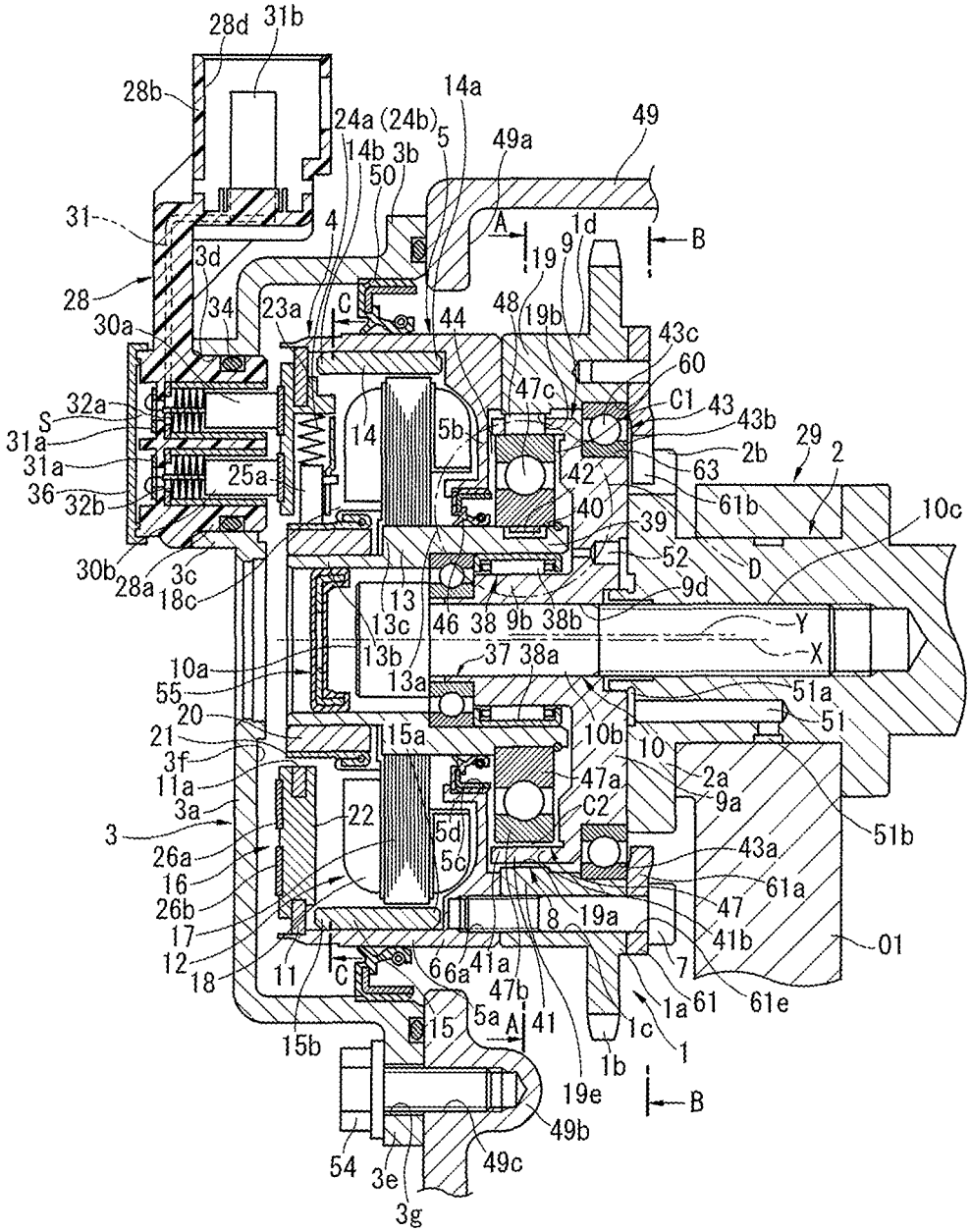
FIG. 1 illustrates a longitudinal cross-sectional view of a valve timing control apparatus of an internal combustion engine according to various embodiments of the present invention.
Figure 2:
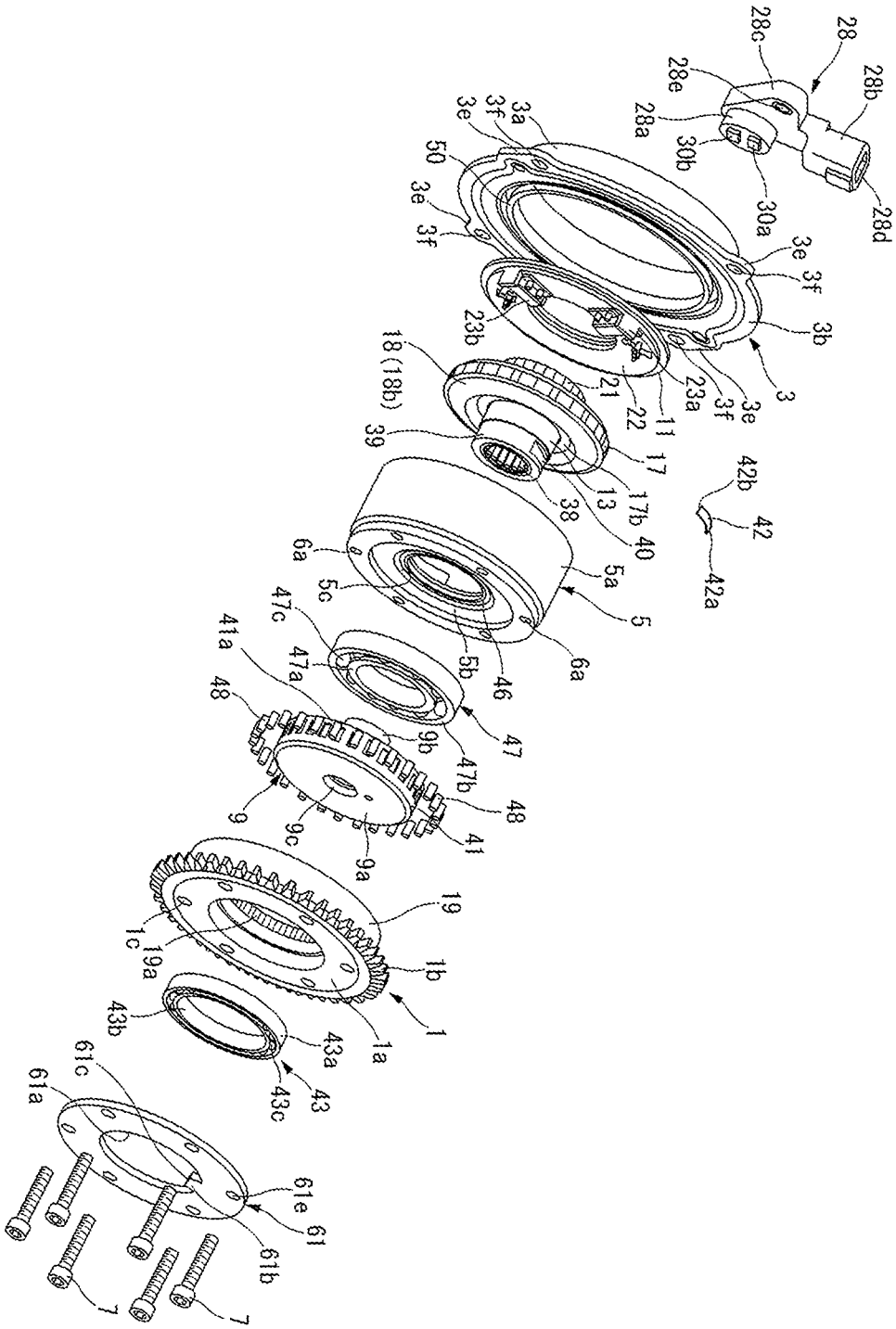
FIG. 2 is an exploded perspective view illustrating main constituent members according to various embodiments of the present invention.

The valve timing control apparatus of various embodiments of the present invention is applied to an intake valve. As shown in FIG. 1 and FIG. 2, the valve timing control apparatus includes a timing sprocket 1, which is a drive rotational body, rotated and driven by a crankshaft of the internal combustion engine, a camshaft 2 that is rotatably supported by a bearing 29 mounted on a cylinder head (01) and is rotated by torque from the timing sprocket 1, a cover member 3 disposed in front of the timing sprocket 1, and a phase changing mechanism 4 that is disposed between the timing sprocket 1 and the camshaft 2 to change a relative rotation phase of the timing sprocket 1 and the camshaft 2 according to a driving state of the internal combustion engine.

The timing sprocket 1 is formed of an iron-based metal to have a cylindrical shape, and includes a sprocket main body 1*a*, gears 1*b* that are integrated with an outer circumference of the sprocket main body 1*a* and receive torque of the crankshaft through a timing chain; and an inner tooth formation part 19 that is extendedly integrated with a front end of the sprocket main body 1*a*.

In the timing sprocket 1, one large diameter ball bearing 43 is interposed between driven members 9 described later as driven rotating bodies installed at the front end of the sprocket main body 1*a* and the camshaft 2, and the timing sprocket 1 and the camshaft 2 are supported to relatively rotate by the large diameter ball bearing 43.

The large diameter ball bearing 43 includes an outer wheel 43*a* and an inner wheel 43*b* and a ball 43*c* interposed between the wheels 43*a* and 43*b*. The outer wheel 43*a* is fixed to an inner circumferential side of the sprocket main body 1*a*, while the inner wheel 43*b* is fixed to an outer circumferential side of a driven member 9.

An outer wheel fixing part 60 of a circular groove shape is provided at the inner circumferential side of the sprocket main body 1*a*.

The outer wheel fixing part 60 is formed to have a step shape such that the outer wheel 43*a* of the large diameter ball bearing 43 is press-inserted thereinto from an axis direction, and it is positioned at one side of the axis direction of the outer wheel 43*a*.

The inner tooth formation part 19 is integrated with the sprocket main body 1*a* at the outer circumference of the sprocket main body 1*a*, and is formed to have a cylindrical shape extending toward the phase changing mechanism 4, and a plurality of inner teeth 19*a* with a waveform shape are formed at the inner circumference thereof.

Further, a circular female thread formation part 6 integrated with a motor housing 5 described later is disposed in front of the inner tooth formation part 19.

A circular supporting plate 61 is disposed at an opposite side of the inner tooth formation part 19 of the sprocket main body 1*a*. The supporting plate 61 is formed of a metal plate material so that an outer diameter thereof is substantially equal to that of the sprocket main body 1*a* and an inner diameter thereof the large diameter ball bearing 43 is smaller than that of the outer wheel 43*a* as shown in FIG. 1. A stopper protrusion 61*b* protruding inward a radial direction, that is, in a central axis direction is integrally formed at a predetermined position of an inner circumference surface 61*a* of the supporting plate 61.

Figure 7:
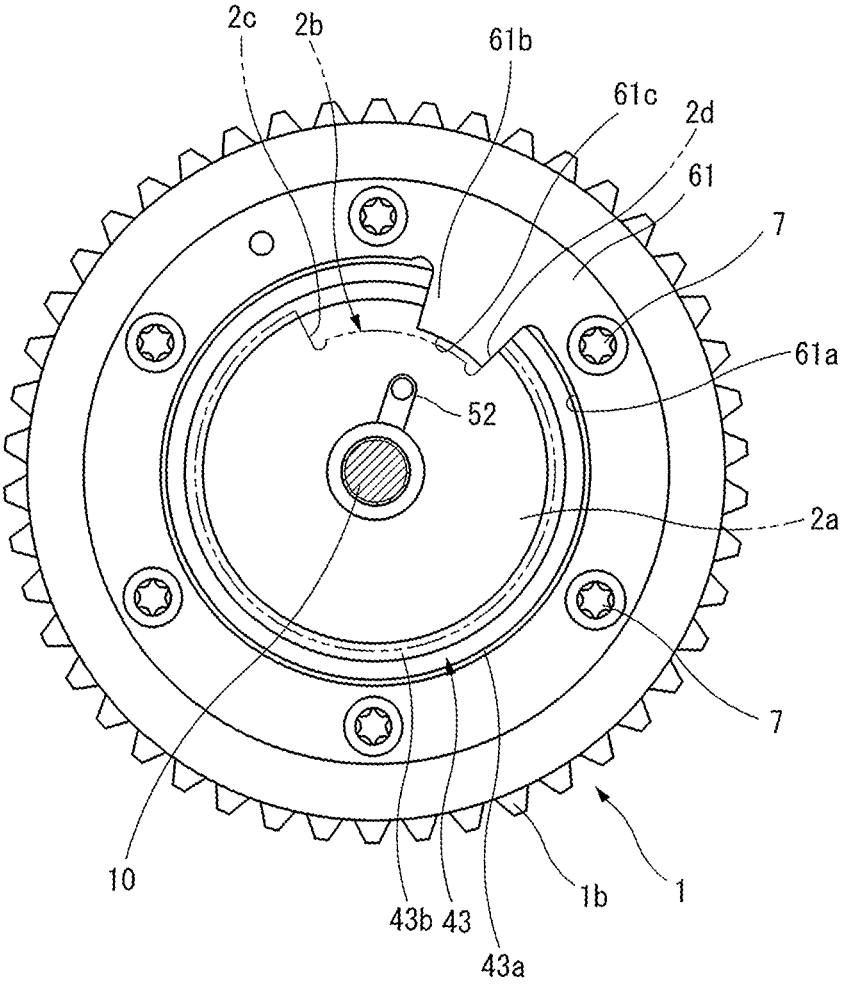
FIG. 7 illustrates a cross-sectional view taken along line B-B of FIG. 1.

As shown in FIG. 1 and FIG. 7, the stopper protrusion 61*b* is substantially formed to have an arc shape, and a front end 61*c* thereof is formed to have a circular arc shape according to an inner circumferential surface of a circular arc shape of a stopper groove 2*b* described later. Further, six bolt insertion holes 61*d* into which each bolt 7 is inserted are through-formed in an outer circumferential portion of the supporting plate 61 in a circumferential direction by an equal interval.

Six bolt insertion hole 1*c* and 61*d* are through-formed in respective outer circumferential portions of the sprocket main body 1*a* (the inner tooth formation part 19) and the supporting plate 61 in respective circumferential directions by an substantially equal interval. In addition, in the female thread formation part 6, six female thread holes 6*a* are formed at respective positions corresponding to the respective insertion holes 1*c* and 61*d*, and the timing sprocket 1, the supporting plate 61, and motor housing 5 are engaged and fastened together in an axis direction by six bolts 7 inserted into the six female thread holes 6*a*.

The sprocket main body 1*a* and the inner tooth formation part 19 include a case of a deceleration mechanism 8 described later.

The sprocket main body 1*a*, the inner tooth formation part 19, the supporting plate 61, and the female thread formation part 6 is formed to have the substantially same outer diameter.

The cover member 3 is fixed to a chain cover 49, and the chain cover 49, as shown in FIG. 1, is disposed along a vertical direction to cover a chain wound on the timing sprocket 1 at the cylinder head 01 and a front end of the cylinder block. In addition, boss portions 49*b* are integrally formed at four circumferential directional positions of a ring-shaped wall 49*a* configuring an opening formed at a position corresponding to the phase changing mechanism 4, and female thread holes 49*c* are formed from the ring-shaped wall 49*a* to an inner region of the respective boss portions 49*b*.

As shown in FIG. 1 and FIG. 2, the cover member 3 is formed of an aluminum alloy material to have a cup shape to be disposed to cover an front end portion of the motor housing 5, and includes a convex cover main body 3*a* and a ring-shaped mounting flange 3*b* integrally formed at an outer circumferential edge of an opening side of the cover main body 3*a*. A cylindrical wall 3*c* is integrally formed at the outer circumferential portion of the cover main body 3*a* along an axis direction, and a holding and supporting (hereinafter, referred to as "maintaining") hole 3*d* is formed inside the cylindrical wall 3*c*, and a supporting body 28 described later is partially connected to an inner circumferential surface of the maintaining hole 3*d*.

Four boss portions 3*e* are formed at the mounting flange 3*b* to be equally spaced (about 90 degree interval) apart from each other in a circumferential direction. As shown in FIG. 1, a bolt inserting hole 3*f* into which a spiral bolt 54 is inserted into and passes through each female thread hole 49*d* formed in the chain cover 49 is through-formed in the respective boss portions 3*e*, and the cover member 3 is fixed to the chain cover 49 by each bolt 54.

An oil seal 50 of a large diameter is interposed between an inner circumferential surface of a step portion of the outer circumferential side of the cover main body 3*a* and the outer circumferential surface of the motor housing 5. The large diameter oil seal 50 is formed so that its transverse cross-section has a shape, a core is laid in a synthetic rubber base thereof, and a ring shape base of an outer circumferential side thereof is inserted into and fixed to a ring shaped step provided at an inner circumferential surface of the cover member 3.

As shown in FIG. 1, the motor housing 5 includes a cylindrical housing main body 5*a* formed to have a barrel-shaped bottom by press-forming iron-based metal material and a sealing plate 11 for sealing a front opening of the housing main body 5*a*, and the sealing plate 11 includes a central metal plate and opposite side magnetic materials made of a synthetic resin with the metal plate therebetween.

A circular plate shaped partition wall 5*b* is provided at a rear side of the housing main body 5*a*, and a large diameter axial insertion hole 5*c* which an eccentric shaft 39 described later is insert into and passes through is formed at a substantially central portion of the partition wall 5*b*, and a cylindrical extension protrusion 5*d* protruding in an axis direction of the camshaft 2 is integrally installed at an edge of the axial insertion hole 5*c*. The female thread formation part 6 is integrally formed at an outer circumferential side of a front surface of the partition wall 5*b*.

The camshaft 2 includes two driving cams for each cylinder for opening and operating an intake valve at an outer circumference thereof, and a flange part 2*a* is integrally formed at a front side thereof.

As shown in FIG. 1, the outer diameter of the flange part 2*a* is formed to be slightly greater than that of a fixing part 9*a* of the driven member 9 described later, and after assembling respective constituent components, the flange part 2*a* is disposed so that the outer circumferential portion of the front surface thereof contacts axial directional outside surface of the inner wheel 43*b* of the large diameter ball bearing 43. Further, the front surface of the flange part 2*a* is combined with the driven member 9 in an axis direction by a cam bolt 10 while directly contacting the driven member 9 in the axis direction.

As shown in FIG. 7, a stopper concave groove 2*b* in which the stopper convex portion 61*b* of the supporting plate 61 puts is formed at the outer circumference of the flange part 2*a* along a circumferential direction. The stopper concave groove 2*b* is formed as a circular arc shape of a predetermined length in the circumferential direction, and respective opposite side edges of the rotated stopper protrusion 61*b* directly contacts respective facing edges 2*c* and 2*d* of the circumferential direction in a range of the length range such that a relative rotational position of the maximum retarded or advanced position of the camshaft 2 with respect to the timing sprocket 1 is limited.

In addition, the stopper convex portion 61*b* is disposed to be further spaced apart from the camshaft 2 than a portion fixed to the outer wheel 43*a* of the large diameter ball bearing 43 of the supporting plate 61 in an axis direction, and the fixing part 9*a* of the driven member 9 is disposed in a non-contact state in the axis direction. Accordingly, interference between the stopper convex portion 61*b* and the fixing part 9*a* may be sufficiently suppressed.

The stopper convex portion 61*b* and the stopper concave groove 2*b* form a stopper mechanism.

As shown in FIG. 1, a cross-section of a head portion 10*a* of the cam bolt 10 supports the inner wheel of the small diameter ball bearing 37 from an axis direction, and a male thread 10*c* screwed into a female thread formed from the end side of the camshaft 2 to an inner axis direction is formed at the outer circumference of the axial portion 10*b* thereof.

As shown in FIG. 1 and FIG. 2, the driven member 9 is integrally formed of an iron-based metal, and includes a circular disc-shaped fixing part 9*a* formed at a rear side thereof (the side of the camshaft 2), a cylindrical portion 9*b* protruding from an inner circumferential front surface of the fixing part 9*a* to an axis direction, and a maintaining mechanism 41, a cylindrical maintaining member that is integrally formed at the outer circumferential portion of the fixing part 9*a* to maintain a plurality of rollers 48.

The rear surface of the fixing part 9*a* contacts the front surface of the flange part 2*a* of the camshaft 2 such that the fixing part 9*a* is press-fixed to the flange part 2*a* in an axis direction by an axial force of the cam bolt 10.

As shown in FIG. 1, an insertion hole 9*c* into which the axial portion 10*b* of the cam bolt 10 is insert is through-formed in the central portion of the cylindrical portion 9*b*, and a needle bearing 38 which is a bearing member is installed at the outer circumferential side of the cylindrical portion 9*b*.

The maintaining mechanism 41, as shown in FIG. 1, is bent to have an "L" shape from the front side of the outer circumferential portion of the fixing part 9*a*, and it is formed as a cylindrical shape protruding in the same direction as the cylindrical portion 9*b*.

A cylindrical front end portion 41*a* of the maintaining mechanism 41 extends and protrudes in a direction of the partition wall 5*b* of a motor housing main body 5*a* through a circular concave receiving space 44 formed between the female thread formation part 6 and the extension protrusion 5*d*. Moreover, as shown in FIG. 1 to FIG. 4, a plurality of roller maintaining holes 41*b* with a substantially rectangular shape for rotatably maintaining the plurality of rollers 48 are respectively provided at an equal interval positions in a circumferential direction of the cylindrical front end portion 41*a*. The roller maintaining holes 41*b* allow the respective rollers 48 to move in a radial direction and limit them to move in a circumferential direction, and the number of them is one less than that of gears of the inner teeth 19*a* of the inner tooth formation part 19.

An inner wheel fixing part 63 in which the inner wheel 43*b* of the large diameter ball bearing 43 is fixedly press-inserted while setting an axis directional position is notch-formed between the outer circumferential portion of the fixing part 9*a* and a lower combining portion of the maintaining mechanism 41.

The phase changing mechanism 4 mainly includes the electrical motor 12 disposed at the frond side of cylindrical portion 9*b* of the driven member 9 and the deceleration mechanism for decelerating a rotational speed of the electrical motor 12 and then transmitting it to the camshaft 2.

As shown in FIG. 1 and FIG. 2, the electrical motor 12 is a brush DC motor, and includes the motor housing 5 that is a yoke integrally rotating together with the timing sprocket 1, a motor output shaft 13 rotatably installed inside the motor housing 5, a pair of semicircular arc shaped permanent magnets 14 and 15 which are stators fixed to the inner circumferential surface of the motor housing 5, and a stator fixed to the maintaining plate 11.

The motor output shaft 13 is formed as a stepped cylindrical shape to serve as an armature, and includes a large diameter portion 13*a* of the side of the camshaft 2 and a small diameter portion 13*b* of the side of the maintaining body 28, through a stepped portion 13*c* formed at a substantially central position of an axis direction. The large diameter portion 13*a* is integrally formed with an eccentric rotational shaft 39 in which an iron-core rotor 17 is fixedly press-inserted into an outer circumference thereof and in which some of the deceleration mechanism 8 is formed at a rear side thereof.

A circular ring member 20 is fixedly press-inserted into the outer circumference of the small diameter portion 13*b*, and a commutator 21 is fixedly press-inserted into an outer circumferential surface of the circular ring member 20 in an axial direction, such that the axial directional position is determined by an outer surface of the stepped portion 13*c*. The outer diameter of the circular ring member 20 is substantially equal to that of the large diameter portion 13*a*, and a length of the axial direction thereof is slightly shorter than that of the small diameter portion 13*b*.

A stopper 55 for preventing lubricant that is supplied to the motor output shaft 13 and the eccentric shaft 39 to lubricate bearings 37 and 38 from being leaked to the outside is fixedly pressed-inserted into the inner circumferential surface of the small diameter portion 13*b*.

The iron-core rotor 17 is formed of a magnetic material having a plurality of magnetic poles, and includes a bobbin of which a wire of a coil 18 is wound on slots of an outer circumferential side.

The commutator 21 is formed of a circular ring shaped conductive material, and a coil wire drawn out of the coil 18 is electrically connected to segments divided by the number of poles of the iron-core rotor 17. That is, an end of the coil wire is inserted into a flap portion formed at the inner circumferential side to be electrically connected.

The permanent magnets 14 and 15 are wholly formed as a cylindrical shape to have a plurality of magnetic poles in a circumferential direction, and an axial directional position is offset-disposed in front of a fixed position of the iron-core rotor 17. That is, axial directional centers of the permanent magnets 14 and 15, as shown in FIG. 1, are offset-disposed from an axial center of the iron-core rotor 17 to the stator. Accordingly, edges of the permanent magnets 14 and 15 are overlapped with the commutator 21 and first brushes 25*a* and 25*b* of the stator described later in a radial direction.

Figure 8:
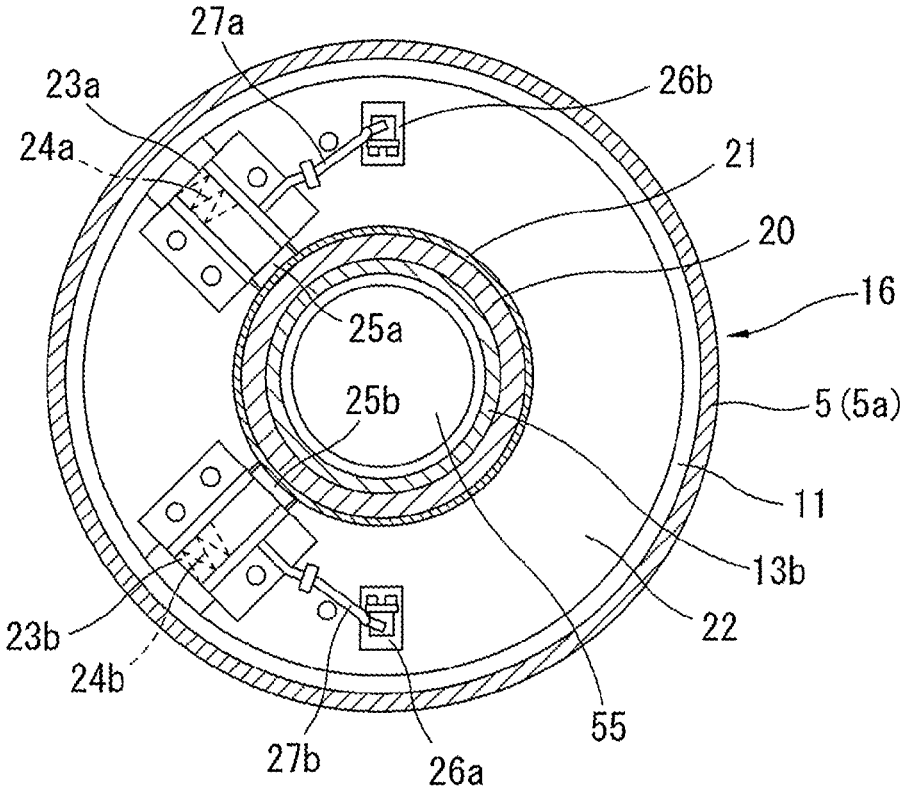
FIG. 8 illustrates a cross-sectional view taken along line C-C of FIG. 1.

As shown in FIG. 8, the stator forms some of the sealing plate 11, and includes a circular plate shaped resin plate 22 integrally installed at the inner circumferential side, a pair of resin holders 23*a* and 23*b* installed inside the resin plate 22, a pair of first switching brushes 25*a* and 25*b* that are slidably accommodated inside the respective resin holders 23*a* and 23*b* along a diameter direction and each end surface of which resiliently contacts the outer circumferential surface of the commutator 21 from the radial direction by spring force of the coil springs 24*a* and 24*b*, dual circular ring shaped power supplying slip rings 26*a* and 26*b* fixedly laid in front surfaces of the resin holders 23*a* and 23*b* in a state in which each outer end surface thereof is exposed, and pig tail harnesses 27*a* and 27*b* for electively connecting the respective first brushes 25*a* and 25*b* and the respective slip rings 26*a* and 26*b*.

The outer circumferential portion of the sealing plate 11 is fixedly positioned in a concave stepped portion formed at the front side inner circumference of the motor housing 5 by caulking, and an axial insertion hole 11*a* through which one side of the motor output shaft 13 is inserted and penetrates is through-formed in a central position of the sealing plate 11.

The maintaining body 28 integrally molded with a synthetic resin material is fixed to the cover main body 3*a*. The maintaining body 28, as shown in FIG. 1 and FIG. 2, is formed to have a substantially "L" shape which is laterally viewed, and includes a substantially cylindrical brush maintaining 28*a* inserted into the maintaining hole 3*d*, a connector 28*b* disposed on the brush maintaining portion 28*a*, a bracket 28*c* that integrally protrudes from one lateral surface of the brush maintaining portion 28*a* and is fixedly bolted to the cover main body 3*a*, and a pair of power supplying terminals 31 and 31 mostly laid inside the maintaining body 28.

The brush maintaining portion 28*a* substantially extends in a horizontal direction (an axis direction), and a pair of angled barrel shaped brush guiding portion are respectively fixed in a fixing hole of a circular cylinder shape with a pair of bottoms which are formed to be parallel to upper and lower inner positions therein (inner and outer circumferential sides with respect to an axial core of the motor housing 5). A pair of power supplying brushes 30*a* and 30*b*, the front surfaces of which contact the respective power supplying slip rings 26*a* and 26*b* in an axial direction, are slidably maintained inside the respective brush guiding portions in an axial direction. The respective power supplying brushes 30*a* and 30*b* are formed as an angled barrel shape to have a predetermined axial directional length, and they forms some of a power supplying mechanism together with the respective power supplying slip rings 26*a* and 26*b*.

Penetration holes into which pig tail harnesses described later are inserted are through-formed in lower bottom walls of the pair of fixing holes, and a space S meeting the respective penetration holes is formed outside the bottom walls.

The space S is formed to have a circular shape, and a depth thereof is set to have a size that the respective pig tail harnesses 33 and 33 may be bent for a moving distance to be absorbed when the respective power supplying brushes 30*a* and 30*b* backwardly move in the brush guiding portion. Moreover, the space S is sealed so that liquid therein is leaked by a circular shaped cap 36, an axial directional opening of which is formed of a synthetic resin material such as the maintaining body 28.

The pair of power supplying terminals 31 and 31 are vertically parallel to each other, and are formed to have a crank shape, and terminals 31*a* and 31*a* of one side (a lower side) thereof are disposed to be exposed from the outer surfaces of the bottom walls, while terminals 31*b* and 31*b* of the other side (an upper side) thereof protrude to an inserting and combining groove 28*d* of the connector 28*b*. Further, the other side terminals 31*b* and 31*b* are connected to an external control unit through an external insertion terminal or harness.

The respective power supplying brushes 30*a* and 30*b*, as shown in FIG. 1 and FIG. 2, are formed to have a substantially rectangular shape, and are pressed by spring force of a pair of second coil springs 32*a* and 32*b* resiliently mounted between respective rear surfaces thereof and edges (that is, inner surfaces of the bottom walls) of the respective fixing holes in a direction of the slip rings 26*a* and 26*b*.

A pair of external pre-baking modifiable pig tail harnesses is installed between the rear side of the power supplying brushes 30*a* and 30*b* and the one side terminals 31*a* and 31*a*.

A seal member 34, which seals the brush maintaining portion 28*a* by resiliently contacting the front surface of the cylindrical wall 3*b* when the brush maintaining portion 28*a* is inserted into and penetrates through the maintaining hole 3*c*, is maintained in an insertion mounting groove of a circular ring shape formed at the outer circumference of the base of the brush maintaining portion 28*a*.

As shown in FIG. 2, a bolt insertion hole 28*e* is through-formed in a substantially central position of the bracket 28*c*. The bolt insertion hole 28*e*, as a spiral bolt is inserted into an external female thread hole formed in the cover main body 3*a*, allows all the maintaining body 28 to be fixed to the cover main body 3*a*.

The motor output shaft 13 and the eccentric shaft 39 are rotatably supported by the small diameter ball bearing 37 formed at the thin barrel shaped outer circumferential surface integrally formed at the front side of the cylindrical portion 9*b* of the driven member 9, and the needle bearing 38 installed at the outer circumferential surface of the cylindrical portion 9*b* of the driven member 9 to be disposed at the axial directional lateral surface of the small diameter ball bearing 37.

The needle bearing 38 includes a cylindrical retainer 38*a* press-inserted into the inner circumferential surface of the eccentric shaft 39, and a plurality of needle rollers 38*b* rotatably maintained inside the retainer 38*a*. The needle rollers 38*b* rollably move on the outer circumferential surface of the cylindrical portion 9*b* of the driven member 9.

The inner wheel of the small diameter ball bearing 37 is fixedly interposed between the front edge of the cylindrical portion 9*b* of the driven member 9 and a head 10*a* of the cam bolt 10, while the outer wheel thereof is fixedly press-inserted into an inner circumferential surface of a step enlargement shape of the eccentric shaft 39 and directly contact a stepped edge formed at the inner circumferential surface of the step enlargement shape of the eccentric shaft 39 such that an axial direction thereof is positioned.

An oil seal 46 (a small diameter seal member) for preventing lubricant of the motor housing 5 of the electrical motor 12 to be leaked inside the case of the deceleration mechanism 8 is installed between the outer circumferential surface of the motor output shaft 13 (the eccentric shaft 39) and the inner circumferential surface of the extension protrusion 5*d* of the motor housing 5.

The control unit detects an engine state and controls the engine depending on various signals of a crank position sensor or an airflow meter, a coolant temperature sensor, an accelerator position sensor, etc., and is electrically connected to the coil 18 to control rotation of a motor output shaft 13 so as to control a relative rotation phase with respect to the timing sprocket 1 of the camshaft 2 through the deceleration mechanism 8.

As shown in FIG. 1 to FIG. 4, the deceleration mechanism 8 mainly includes the eccentric shaft 39 of a cylindrical shape that eccentrically rotates, an intermediate diameter ball bearing 47 installed at the outer circumference of the eccentric shaft 39, a plurality of the rollers 48 installed at the outer circumference of the intermediate diameter ball bearing 47, the maintaining mechanism 41 for maintaining the respective rollers 48 in a front movement direction while allowing them to move in a radial direction, and the driven member 9 integrally combined with the maintaining mechanism 41.

As shown in FIG. 1 to FIG. 4, the eccentric shaft 39 is formed to extendedly protrude from the outer edge of the large diameter portion 13*a* of the motor output shaft 13, and the outer diameter thereof is substantially equal to that of the large diameter portion 13*a* of the motor output shaft 13, and a cam surface 39*a* of a circular ring groove shape is provided in the outer circumferential surface thereof.

An axial center (Y) of the outer diameter of the cam surface 39*a* become slightly eccentric from an axial center (X) of the motor output shaft 13 to the radial direction as a thickness of the circumferential direction thereof varies, and a recess portion 40 (accommodating a pressing member) as a groove portion provided from a minimum thickness portion 39*b* to an maximum thickness portion of an opposite side of the radial direction is formed, and a leaf spring 42 which is the pressing member is accommodated in the recess portion 40.

Figure 3:
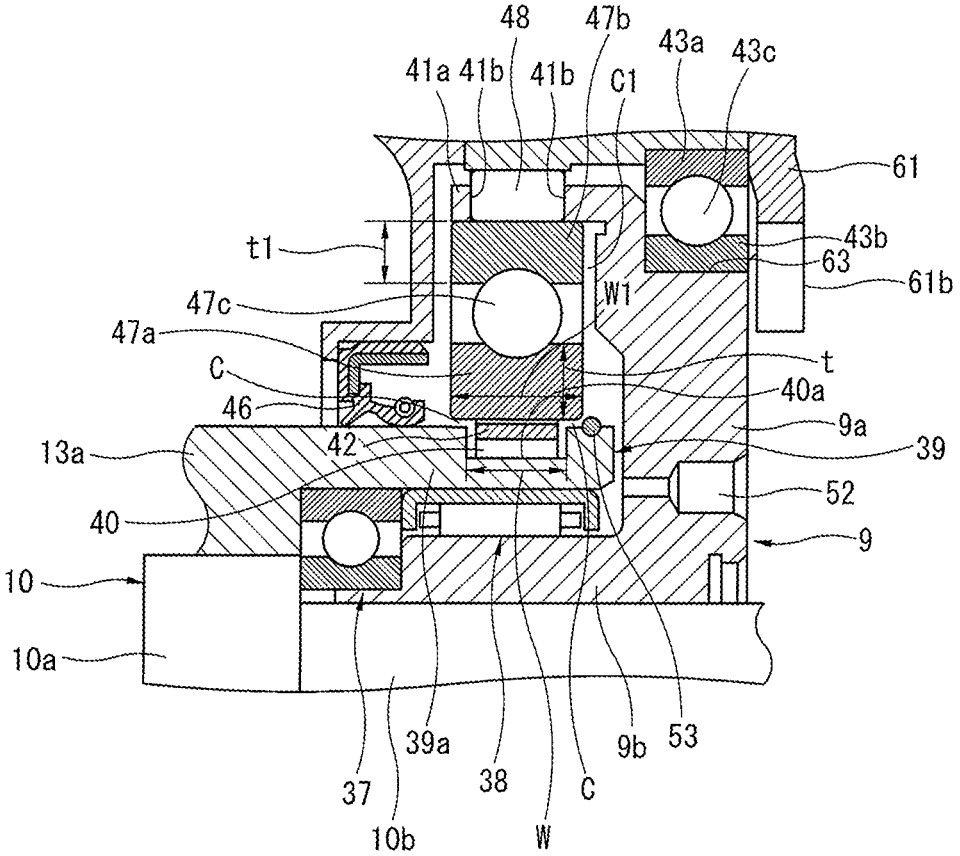
FIG. 3 illustrates an enlarged view of portion "D" surrounded by a one-point chain line in FIG. 1.
Figure 4:
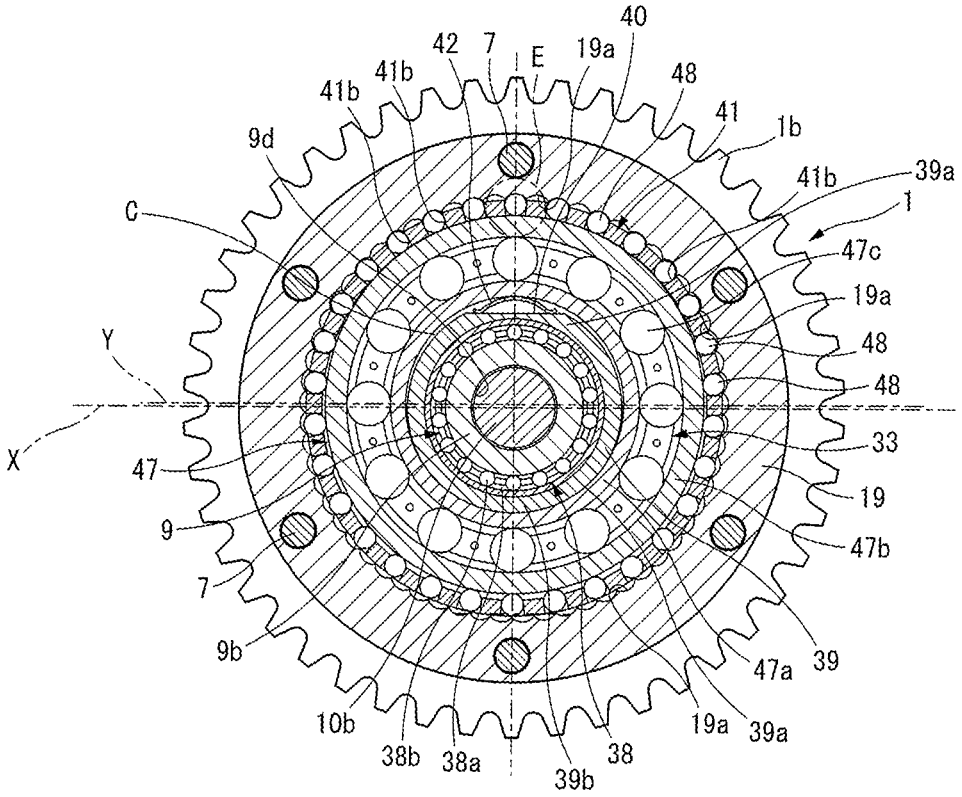
FIG. 4 illustrates a cross-sectional view taken along line A-A of FIG. 1.

Specifically, the recess portion 40, as shown in FIGS. 1, 3, and 4, is long cut in a rectangular shape along the tangent direction of the outer circumferential portion of the maximum thickness portion of the eccentric shaft 39 to have a "D" shape (that is, a crescent shape), and its bottom surface 40*a* is formed to have a flat shape.

As shown in FIG. 3, a width (W) of the recess portion 40 is smaller by W1 than that of an outer wheel 47*a* of the intermediate diameter ball bearing 47 described later, and the recess portion 40 is formed at a center of a width of the outer wheel 47*a*, that is, the recess portion 40 is disposed in an inner region between opposite edges of the outer wheel 47*a*.

Figure 6A:
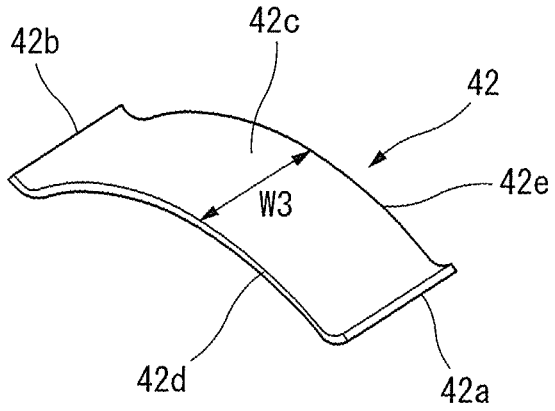
Figure 6B:
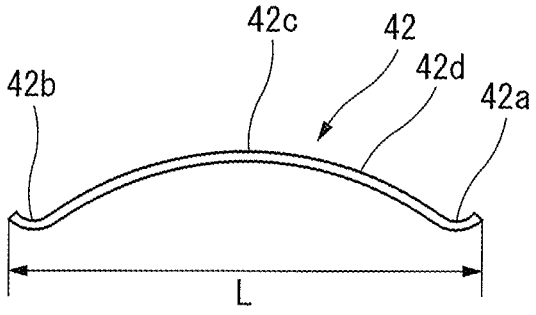

As shown in FIG. 6, the leaf spring 42 is formed by bending a substantially rectangular steel plate in a circular arc shape, the opposite end portions 42*a* and 42*b* of a length direction contacting the bottom surface 40*a* of the recess portion 40 are bent in a reverse curve shape, and a circular arc shaped top portion 42*c* is disposed at a central portion of a length direction.

Further, a width (W3) of the leaf spring 42 is slightly smaller than that of the recess portion 40, and when the leaf spring 42 is elastically changed in a stretched direction, it is formed so that its opposite edges 42*d* and 42*e* do not interfere with width directional opposite inside surfaces of the recess portion 4. Further, a length (L) of the leaf spring 42 is formed to be sufficiently smaller than that of the recess portion 40, and may be elastically changed in a freely stretched direction in the recess portion 40.

In a state in which the leaf spring 42 is set to recess portion 40, lower edges the opposite end portions 42*a* and 42*b* previously contacts the bottom surface 40*a* of the recess portion 40, while the top portion 42*c* face the inner circumferential surface of the inner wheel 47*a* of the intermediate diameter ball bearing 47 with a slight clearance therebetween.

The intermediate diameter ball bearing 47, as shown in FIG. 1 and FIG. 3, includes an inner wheel 47*a* and an outer wheel 47*b* disposed to be substantially overlapped with each other at a radial directional position of the needle bearing 38, and a ball 47*c* interposed between the wheels 47*a* and 47*b*.

As shown in FIG. 4, an inner circumferential portion of the inner wheel 47*a* is not press-inserted into the outer circumference of cam surface 39*a* of the eccentric shaft 39, and a minute clearance (C) for ensuring spring force of the leaf spring 40 is provided in the inner wheel 47*a*, and its front edge directly contacts a stepped edge 39*b* of the large diameter portion 13*a* of the motor output shaft 13, while its rear edge directly contacts a snap ring 53 fixedly inserted into a front side of the cam surface 39*a*, thus an axial direction of the inner wheel 47*a* is position together with the stepped edge 39*b* and the inner wheel 47*a* is controlled to not be deviated from the cam surface 39*a*.

The outer wheel 47*b* is not fixed in the axial direction, but is in a free state. That is, one surface of the outer wheel 47*b* which is disposed at the axial directional side of the electrical motor 12 does not contact any surface, and the other surface thereof is provided with a first clearance (C1) between inner surfaces of the corresponding maintaining mechanism 41, thus the outer wheel 47*b* is in a free state. Moreover, the outer circumferential surface of the outer wheel 47*b* directly movably contacts the outer circumferential surface of each roller 48, and a second clearance (C2) of a circular ring shape is formed at the outer circumferential side of the outer wheel 47*b*, thus all the intermediate diameter ball bearing 47 may eccentrically move in the radial direction by the second clearance (C2) according to eccentric rotation of the eccentric shaft 39.

Although the outer diameter of the outer wheel 47*b* of the ball bearing 47 is substantially equal to that of the outer wheel of a typical general ball bearing, a radial directional thickness (t) of the inner wheel 47*a* is greater than that of the inner wheel of the typical ball bearing. Accordingly, the inner wheel thickness (t) is set to be greater than the radial directional thickness (t1) of the outer wheel 47*b*.

Accordingly, since the outer diameter of the inner wheel 47*a* is formed to be essentially greater than the conventional typical case, the number of the balls 47*c* disposed is greater than the number of the conventional typical ball bearing.

Each roller 48 is formed of an iron-based metal, and it is configured to move in the radial direction according to the eccentric movement of the intermediate diameter ball bearing 47, to decelerate in the inner tooth 19*a* of the inner tooth formation part 19, to be guided in the circumferential direction by the opposite edges of roller maintaining hole 41*b* of the maintaining mechanism 41, and then to oscillate and move in the radial direction.

Figure 5:
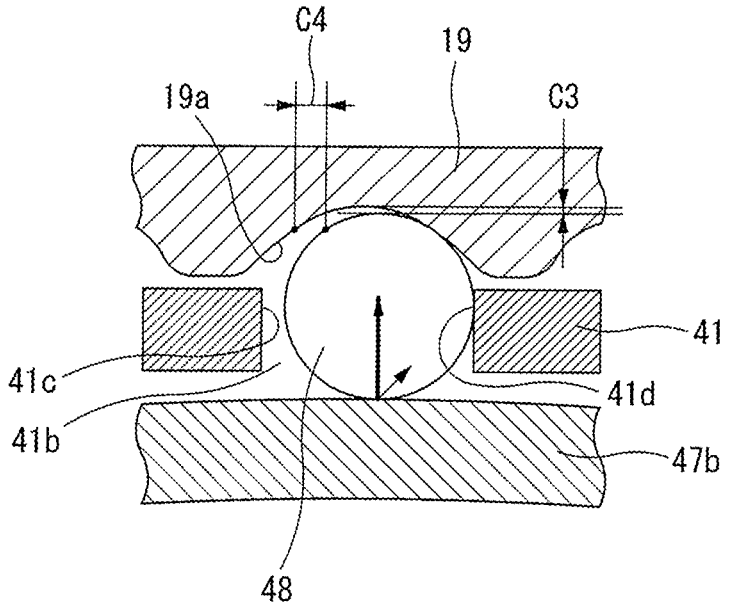
FIG. 5 illustrates an enlarged view of portion "E" surrounded by a one-point chain line in FIG. 4.

Further, in a state in which each roller 48 is accommodated in the roller maintaining hole 41*b* of the maintaining mechanism 41, when the roller 48 is interposed between the inner tooth 19*a* of the inner tooth formation part 19 and the outer wheel 47*b* of the intermediate diameter ball bearing 47, as shown in FIG. 5, a minute radial clearance (C3) is provided between the outer surface of the roller 48 and the inner surface of the inner tooth 19*a*, and a minute cage clearance (C4) is provided between the outside of the roller 48 and one lateral surface 41*c* facing the roller maintaining hole 41*b*. The clearances (C3, C4) need to ensure an initial operational responsiveness of the roller 48 during the change operation of the deceleration mechanism 8.

The inside of the case of the deceleration mechanism 8 is configured so that a lubricant supplying unit may supply lubricant thereto. The lubricant supplying unit is provided inside the bearing 29 of the cylinder head 01, and includes an oil supplying path through which lubricant is supplied from an external main oil gallery, an oil supplying hole 51 that is formed in the inner axial direction of the camshaft 2 and communicates with the oil supplying path through a ring shaped groove 51*b*, as shown in FIG. 1, and the small diameter oil hole 52 that penetrates in the inner axial direction of the driven member 9, one side of which is opened to the oil supplying hole 51, and the other side of which is opened closely to the needle bearing 38 and the intermediate diameter ball bearing 47, wherein the lubricant supplied therein is discharged from three oil discharging holes of the large diameter formed to penetrate through the driven member 9.

The lubricant is supplied to the receiving space 44 by the lubricant supplying unit and is stayed therein so as to lubricate the intermediate diameter ball bearing 47 and the rollers 48, and the lubricant supplying unit supplies the lubricant inside the motor output shaft 13 of the eccentric shaft 39 so as to lubricate the needle bearing 38, the small diameter ball bearing 37, etc. The small diameter oil seal 46 prevents the lubricant stayed in the receiving space 44 from being leaked from the motor housing 5.

[Operation of Various Embodiments of the Present Invention]

When the crankshaft of the engine is rotated and driven, the timing sprocket 1 is rotated through the timing chain 42, and then torque thereof is transmitted to the motor housing 5, that is, the electrical motor 12 through the inner tooth formation part 19 and the female thread formation part 6, thus the electrical motor 12 is rotated in synchronization. In this case, torque of the inner tooth formation part 19 is transmitted from the respective rollers 48 to the camshaft 2 through the maintaining mechanism 41 and the driven member 9. Accordingly, the intake valve is opened or closed by the cam of the camshaft 2.

While the engine is started and then operates, the control unit supplies current to the coil 18 of the electrical motor 12 through the terminals 31 and 31, the pig tail harnesses 33 and 33, the power supplying brushes 30*a* and 30*b*, and the slip rings 26*a* and 26*b*. Accordingly, the motor output shaft 13 is rotated and driven, and its torque is decelerated by the deceleration mechanism 8 to be transmitted to the camshaft 2.

That is, when the eccentric shaft 39 eccentric-rotates according to the rotation of the motor output shaft 13, the roller 48 is guided in the radial direction in the roller maintaining hole 41*b* of the maintaining mechanism 41 for each rotation of the motor output shaft 13, and sequentially moves from one inner tooth 19*a* of the inner tooth formation part 19 to an adjacent inner tooth 19*a* to rotate in the circumferential direction to be contacted. The motor output shaft 13 is decelerated and rotated by the rotating connection of the respective rollers 48, and the decelerated torque is transmitted to the driven member 9. In this case, the deceleration ratio may be arbitrarily set based on the number of the rollers 48.

Accordingly, the camshaft 2 relatively forward-rotates with respect to the timing sprocket 1 such that the relative rotation phase is changed, thus the closing/opening timing of the intake valve is changed and controlled in advance or retardation.

The maximum position limit (angular position limit) of the forward relative rotation of the camshaft 2 with respect to the timing sprocket 1 is performed by each side of the stopper convex portion 61*b* directly contacting one of the surfaces 2*c* and 2*d* that face the stopper groove 2*b*.

That is, the driven member 9 rotates in the same direction as the rotating direction of the timing sprocket 1 according to the eccentric rotation of the eccentric shaft 39, such that one lateral surface of the stopper protrusion 61*b* contacts one facing surface 1*c* of the stopper concave groove 2*b*, 1*c*, thus further rotating in the same direction is limited. Accordingly, the relative rotation phase of the camshaft 2 with respect to the timing sprocket 1 is changed to the maximum in advance.

Meanwhile, the driven member 9 rotates reversely to the rotating direction of the timing sprocket 1, such that the other lateral surface of the stopper protrusion 61*b* contacts the other facing surface 2*d* of the stopper concave groove 2*b*, 1*c*, thus further rotating is limited. Accordingly, the relative rotation phase of the camshaft 2 with respect to the timing sprocket 1 is changed to the maximum in retardation.

As a result, the closing/opening timing of the intake valve is changed to the maximum in advance or retardation, thus fuel efficiency or power of the engine may be improved.

In various embodiments of the present invention, when the eccentric shaft 39 rotates according to the rotation of the motor output shaft 13 of the electrical motor 12, the intermediate diameter ball bearing 47 is entirely pressed slightly in the radial direction while resiliently contacting the inner circumferential surface of the inner wheel 47*a* of the intermediate diameter ball bearing 47 in the radial direction by the spring force of the leaf spring 42 positioned at the maximum thickness portion through the recess portion 40. Accordingly, the roller 48 is upwardly lifted in an arrow direction of FIG. 5, thereby reducing the radial clearance (C3) (backlash).

As described above, by reducing radial clearance (C3), it is possible to reduce the rotating directional clearance (C4), thus interference between the roller 48 and the inner surface of the inner tooth 19*a* is suppressed, and vibration and impact sound may be greatly reduced. Accordingly, it is possible to prevent quality of the deceleration mechanism 8 from deteriorating.

Although the clearances (C3 and C4) is reduced by the spring force of the leaf spring 42, since the clearances are not structurally reduced but reduced by the elastic force of the leaf spring 43, the operational responsiveness of the deceleration mechanism 8 is not affected.

Further, in the present exemplary embodiment, since it is unnecessary to previously prepare many rollers 48 having different outer diameters as in the conventional art, production costs of the rollers 48 may be reduced. Further, since the process of re-assembling the rollers 48 is unnecessary, assembling efficiency and costs may be improved.

Since the top portion 42*c* of the leaf spring 42 elastically contacts the inner circumferential surface of the inner wheel 47*a*, the corresponding contact points are automatically arranged to be spaced apart from the recess portion 40 and the inner wheel 47*a* to the maximum distance.

In addition, when the leaf spring 42 is elastically changed, since the freely stretchable opposite end portions 42*a* and 42*b* in the recess portion 40 limit no movement and contact according to the flat bottom surface 40*a* of the concave portion 40, it is possible to obtain a stable spring weight.

Further, since the radial directional thickness (t) of the inner wheel 47*a* of the intermediate diameter ball bearing 47 is greater than the radial directional thickness (t1) of the outer wheel 47*b*, the number of the balls 47*c* between the inner wheel 47*a* and the outer wheel 47*b* may be greater than that of the balls of the typical ball bearing, thus it is possible to distribute the weight applied to the ball bearing 47 to the respective balls 47*c* during operating. Accordingly, since the load of the ball bearing 47 decreases, deterioration of durability may be suppressed.

In addition, since it is possible to substantially reduce the total outer diameter including the inner wheel 47*a* and the outer wheel 47*b* of the ball bearing 47, the radial directional size of the apparatus may be sufficiently reduced. Therefore, the apparatus may be down-sized.

According to various embodiments of the present invention, it is possible to increase the number of balls 47*c* by further increasing the radial direction thickness (t) of the inner wheel 47*a* of the ball bearing 47 depending on the size and specification of the apparatus. Accordingly, it is possible to reduce the load by distributing the weight.

In addition, the oil seal 46 is disposed to be close to one lateral surface of the inner wheel 47*a* of the ball bearing 47, thus it is possible to limit the oil seal 46 to unnecessarily move in the direction of the camshaft 2.

Further, the recess portion 40 (the pressing member accommodation portion) may be preferably formed to be long cut to have the rectangular shape along the tangential direction of the outer circumferential portion of the maximum thickness portion of the eccentric shaft 39, and the axial directional one side of the recess portion 40 may be preferably opened.

Meanwhile, since the opposite end portions of the length direction of the pressing member contacts the bottom surface of the recess portion and the top portion of the circular arc shape appropriately contacts the inner circumferential surface of the inner wheel of the bearing portion, such that the top portion of the pressing member appropriately contacts the inner circumferential surface of the inner wheel of the bearing portion, the corresponding contact points are automatically arranged to be spaced apart from the recess portion and the inner wheel of the bearing portion to the maximum distance.

The opposite end portions of the pressing member may be formed to have a curved line shape outward the radial direction, and the bottom surfaces of the curve shaped opposite end portions may contact the bottom surface of the recess portion.

The recess portion is formed to have the bottom of the flat shape, thus when the pressing member is elastically changed, since the opposite end portions of the pressing member easily contact the flat bottom, it is possible to obtain a stable spring weight.

Since the recess portion is formed to have the "D" cut shape at the outer circumferential surface of the eccentric rotational shaft, machining operation is facilitated by simply forming the recess portion to have the bottom of the flat "D" cut shape.

The recess portion is formed so that the width thereof ranges from the opposite edges of the width direction of the inner wheel of the bearing portion to the inside of the inner wheel.

The balls may be interposed between the inner wheel and the outer wheel of the bearing portion, and a plurality of rollers may be interposed between the inner wheel and the outer wheel of the bearing portion.

The recess portion may be formed at the inner circumferential surface of the inner wheel of the bearing portion; and the pressing member is formed of the metal plate material, and includes the substantially rectangular plate shaped main body and the curved line portion in which the opposite end portions of the length direction of the plate shaped main body is bent in the curved shape at the radial directional outside.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve timing control apparatus of an internal combustion engine, the valve timing control apparatus comprising:

a driving rotational body to which torque is transmitted from a crankshaft;

a driven rotational body fixed to a camshaft to which torque is transmitted from the driving rotational body;

an electric motor disposed between the driving rotational body and the driven rotational body and relatively rotating the driving rotational body and the driven rotational body when electric power is applied thereto; and a decelerator that decelerates a rotational speed of the electric motor and transmits the decelerated rotational speed to the driven rotational body, wherein the decelerator includes:

an eccentric rotational shaft that receives torque of the electric motor and is eccentric-rotated;

a bearing portion disposed at an outer circumference of the eccentric rotational shaft;

an inner tooth formation part integrally disposed at one of the driving rotational body and the driven rotational body and to which a plurality of inner teeth are provided at an inner circumference of the inner tooth formation part;

a plurality of power transmission bodies that are power-transmissibly disposed between an outer circumferential surface of an outer wheel of the bearing portion and a respective inner tooth of the plurality of inner teeth, wherein an engaged portion of the inner tooth formation part moves in a circumferential direction by eccentric rotation of the eccentric rotational shaft; and a maintaining member integrally disposed at a remaining one of the driving rotational body and the driven rotational body, separating a respective power transmission body of the plurality of power transmission bodies, and allowing the respective power transmission body to move in a radial direction, wherein a recess portion is formed at an inner circumference of the bearing portion, and a pressing member that allows the plurality of power transmission bodies to generate power in a tooth bottom surface direction of the respective inner tooth through the bearing portion is disposed at the recess portion.

2. The valve timing control apparatus of the internal combustion engine of claim 1, wherein the pressing member includes a leaf spring bent in a circular arc shape.

3. The valve timing control apparatus of the internal combustion engine of claim 2, wherein the recess portion is formed with a length along a longitudinal direction in which opposite end portions of the leaf spring are freely stretchable.

4. The valve timing control apparatus of the internal combustion engine of claim 3, wherein the recess portion is formed in a flat bottom shape.

5. The valve timing control apparatus of the internal combustion engine of claim 1, wherein the bearing portion includes balls interposed between an inner wheel and the outer wheel of the bearing portion.

6. The valve timing control apparatus of the internal combustion engine of claim 1, wherein the bearing portion includes a needle bearing having a plurality of rollers interposed between an inner wheel and the outer wheel of the bearing portion.

7. The valve timing control apparatus of the internal combustion engine of claim 1, wherein the pressing member is formed of a metal plate material, and includes a rectangular plate-shaped main body and a curved line portion in which opposite end portions of a longitudinal direction of the rectangular plate-shaped main body are bent to have a curved shape.

8. A valve timing control apparatus of an internal combustion engine, the valve timing control apparatus comprising:

a driving rotational body to which torque is transmitted from a crankshaft;

a driven rotational body fixed to a camshaft to which torque is transmitted from the driving rotational body;

an electric motor that is disposed between the driving rotational body and the driven rotational body and relatively rotates the driving rotational body and the driven rotational body when electric power is applied thereto; and a decelerator decelerating a rotational speed of the electric motor and transmitting the decelerated rotational speed to the driven rotational body, wherein the decelerator includes:

an eccentric rotational shaft receiving torque of the electric motor and eccentrically-rotated;

a bearing portion disposed at an outer circumference of the eccentric rotational shaft;

an inner tooth formation part integrally disposed at one of the driving rotational body and the driven rotational body and of which a plurality of inner teeth are provided at an inner circumference of the inner tooth formation part;

a plurality of power transmission bodies rotatably disposed between an outer circumferential surface of an outer wheel of the bearing portion and a respective inner tooth of the plurality of inner teeth, wherein an engaged portion of the inner tooth formation part moves in a circumferential direction by eccentric rotation of the eccentric rotational shaft; and a maintaining member integrally disposed at a remaining one of the driving rotational body and the driven rotational body, separating a respective power transmission body of the plurality of power transmission bodies, and allowing all the respective power transmission bodies to move in a radial direction, wherein a groove portion is formed at an inner circumference of the bearing portion, and a pressing member that presses the plurality of power transmission bodies against a tooth bottom surface direction of the respective inner tooth through the bearing portion is disposed at the groove portion.

* * * * *